US005746123A

United States Patent [19]

Eigenmann

[11] Patent Number: 5,746,123

[45] Date of Patent: May 5, 1998

[54] PUNCH PRESS HAVING AN ELONGATE SPACE FOR MOUNTING ITS TOOLS

[75] Inventor: Oskar Eigenmann, Arbon, Switzerland

[73] Assignee: Bruderer AG, Frasnacht, Switzerland

[21] Appl. No.: 587,035

[22] Filed: Jan. 16, 1996

[30] Foreign Application Priority Data

Jan. 21, 1995 [EP] European Pat. Off. ..... 95100804

[51] Int. Cl.[6] ..... B30B 1/06

[52] U.S. Cl. ..... 100/208; 72/404; 72/450; 83/615; 83/618; 83/632; 100/257; 100/285

[58] Field of Search ..... 100/208, 257, 100/258 A, 280, 282, 285, 286; 72/404, 450, 451; 83/615, 618, 630, 632

[56] References Cited

U.S. PATENT DOCUMENTS

| | | | |
|---|---|---|---|
| 238,983 | 3/1881 | Stonehouse | 100/286 |
| 2,085,648 | 6/1937 | Glasner | 100/285 |
| 2,105,053 | 1/1938 | Patrick | 100/285 |
| 2,204,413 | 6/1940 | Hubbert | 100/285 |
| 2,738,748 | 3/1956 | Hecht | 100/286 |
| 3,747,452 | 7/1973 | Gilev et al. | 83/618 |
| 4,089,205 | 5/1978 | Mizumoto et al. | 72/450 |
| 4,160,409 | 7/1979 | Portmann | 100/282 |
| 4,276,823 | 7/1981 | Rotzler | 100/282 |
| 4,630,516 | 12/1986 | Koch et al. | 83/615 |
| 5,052,257 | 10/1991 | Eigenmann | 83/615 |

FOREIGN PATENT DOCUMENTS

| | | |
|---|---|---|
| 0387884 | 9/1990 | European Pat. Off. . |
| 0395964 | 11/1990 | European Pat. Off. . |
| 0546265 | 6/1993 | European Pat. Off. . |
| 2900900 | 7/1980 | Germany . |
| 4127181 | 3/1992 | Germany . |
| 543377 | 12/1973 | Switzerland . |

*Primary Examiner*—Stephen F. Gerrity
*Attorney, Agent, or Firm*—Ladas & Parry

[57] ABSTRACT

The eccentric shaft is connected via the connecting rod and slider to single arm levers projecting at both sides away from the slider. At their ends remote from the slider the levers are supported via threaded spindles at the frame of the punch press. Groups of link members are pivotally mounted to the levers. These groups of link members are connected to double lever pairs arranged symmetrically relative to the center line of the frame of the press. Every double lever is pivotally mounted to a pressing column. The pressing columns of a respective pair of double levers are mounted to a relative ram. Each ram is guided by three guide columns, of which two are rigidly connected to a ram and one to the frame of the press. By the symmetrical dividing of the driving structures and the two rams derived therefrom the punch press is given an extremely long space for mounting the tools without that the height of the punch press, the allowable rated output and the moving masses must be kept overly large.

14 Claims, 7 Drawing Sheets

PUNCH PRESS HAVING AN ELONGATE SPACE FOR MOUNTING ITS TOOLS

BACKGROUND OF THE INVENTION

1. Field of the Invention

The present invention relates to a punch press, having a frame, at least one ram, at least one pressing column, a punching space, a structure adapted to produce a stroke movement, a plane of advance of a web, which plane extends through the punching space and is defined by a web which is advanced through the punching space in order to have work performed thereon.

2. Description of the Prior Art

At the modern punching technique the development thereof proceeds in the direction of a complete processing of a raw material, i.e. a complete chip-less production of an article. This means that a punch press is designed to be a complete production center. Aside of the common cutting and deforming (bending) operations mounting and assembling operations are made the longer the more in punch presses, welding processes, bolting processes are performed and, furthermore, threads are formed in such punch presses, too. After every production step made at a web to be worked upon this web is advanced in the punch press by a predetermined distance. Furthermore, measuring apparatuses for ensuring a high quality operating during the course of the production process are made use of. This means that the length of the space for mounting tools, thus the so-called punching space grows the longer the more individual production steps are performed in the punch press. Conclusively, tool mounting spaces growing in length are the longer the more needed.

In order now to obtain a longer tool mounting space it could merely be necessary to scale up a common punch press design. By such procedure, the allowable rated loading grows in the power of two in relation to the scale of the upscaling and the masses will grow in the power of three.

However, in practical operation longer tool mounting spaces are seldom needed together with accordingly higher rated loads. The extreme growing of the masses, specifically of the masses which move in operation, is actually highly undesired.

Therefore, a mere upscaled increasing of the size of a punch press in order to obtain a longer tool mounting space leads to an excessively high price of such machines, to low rotational speeds of such machines, to a high expenditure of energy and dynamical mass forces which can hardly be controlled, specifically in case of a production and treating of fine and highly precise articles.

SUMMARY OF THE INVENTION

Therefore, it is a general object of the invention to provide a punch press, which has a long tool mounting space, and at the same time allows high speeds of rotation of the machine, which does not necessitate a higher expenditure of energy and does not cause large dynamic mass forces.

A further object of the invention is to provide a punch press, in which the structure adapted to produce a stroke movement comprises at least two pivotal points located at a distance from each other in the direction of the advance of a web through the punching space, which two pivotal points are adapted to perform stroke movements when the punch is operating; further in which the punch press comprises a plurality of link members arranged in groups and having a first and a second, opposite end, which first ends are pivotally mounted to the at least two pivotal points of the structure adapted to produce a stroke movement; and comprises double levers each having a first and a second end, which double levers are arranged pair-wise such to form double lever pairs; whereby the link members are pivotally mounted at their second ends at respective further pivotal points to the first ends of the double lever pairs in such an arrangement that the individual double levers of each double lever pair project in opposite directions from each other relative to the further pivotal points and are supported at rocking support points located symmetrically opposite of each other relative to the further pivotal points, which double levers are pivotally mounted at their second ends to a respective pressing column.

A further object is to provide a punch press having double levers arranged in double lever pairs and located in such a manner, that the double lever pairs are arranged in succession relative to the direction of advance of the web through the punching space.

Still a further object is to provide a punch press, in which the structure adapted to produce a stroke movement is pivotally mounted at two pivotal points adapted to perform stroke movements when the punch press is operating to one end of link members arranged in groups, which ends are located at same distances from a plane of symmetry of the frame of the punch press which extends perpendicularly to the direction of advance of the web.

Yet a further object is to provide a punch press, in which the structure adapted to produce a stroke movement includes two single arm levers, each having a first and a second, opposite end, which single arm levers are mounted at their first ends to a respective unit adapted to guide the respective first ends in the direction of the stroke movement, and are supported at their second, opposite ends at the frame of the press, whereby the two pivotal points which are adapted to perform stroke movements when the press is operating of each group of link members are located between the ends of the single arm levers, which single arm levers are supported at their second ends via threaded spindles at the frame of the press in a height adjustable manner, such that the height position of the second end of each single arm lever and accordingly the height position of any ram mounted thereto is adjustable independently from any further ram or synchronously with any further ram.

Yet a further object is to provide a punch press, in which each ram includes at one end area two guide columns arranged at a distance from each other, which guide columns are guided in guiding units mounted to the frame of the press and arranged in the plane of advance of a web; further in which the structure adapted to produce a stroke movement includes at least one connecting rod having a connecting rod pin mounted to sliders guided in slider guides; and in which the punch press includes an eccentric shaft having at least one eccentric section, on which at least one connecting rod is supported; whereby each connecting rod includes at the side opposite its connecting rod pin a projection forming its upper end, which projection is pivotally mounted via a pivot pin to a laterally extending bar; in which the total mass of the guide columns, the rams, and the respective section of the double levers which extends from their point where they are pivotally mounted to the pressure columns up to the rocking support point, equals the total mass of the respective section of the double levers which extends from the rocking support point up to the point where they are pivotally mounted to the link members, the link members, the single arm levers, the sliders, the connecting rods and the connecting rod pins, the eccentric section, the projecting upper ends of the connecting rods, the laterally extending bars pivotally mounted thereto and the pivot pins.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
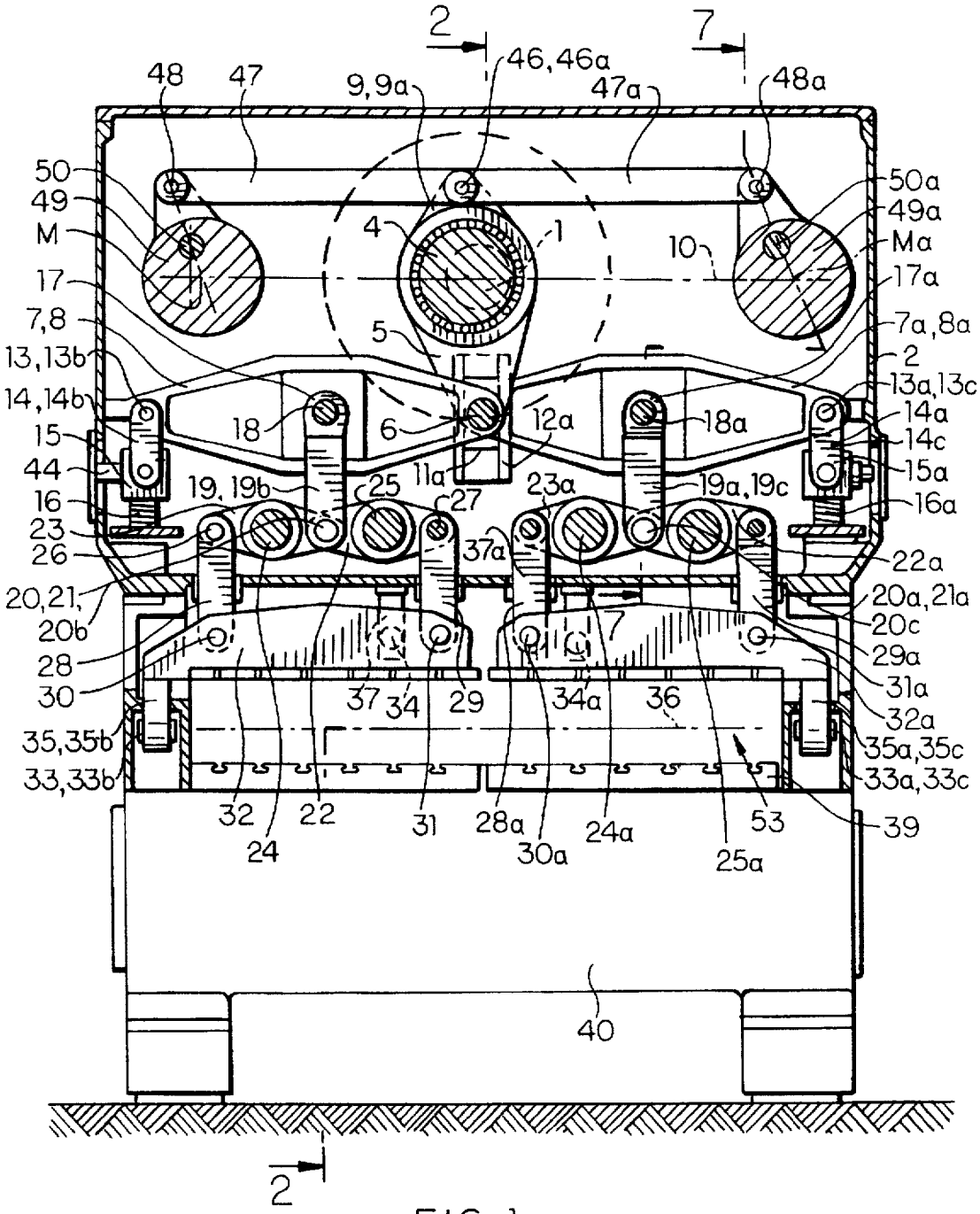
FIG. 1 is a section through a punch press.

The structure adapted to produce a stroke movement described hereinbelow is described as a structure which includes among others an eccentric shaft and structural members mounted or connected, resp., thereto. However, in place of such a design which specifically includes an eccentric shaft other designs of such a structure for producing a stroke movement are foreseen, for instance, structures having a crankshaft, hydraulic drives, drives having cams, etc.

Throughout the specification and the claims a reference is made to a plane of advance of a web, i.e. of the web being worked upon in the punch press. This plane, identified in FIGS. 1 and 3 by the reference numeral 36, is defined by a respective web, e.g. metal strip, which is advanced horizontally in a stepwise manner through the punching space of the punch press. This plane 36 is an imaginary plane and is determined by the position of any web being treated and worked upon in the punch press.

The punch press of the illustrated preferred embodiment includes an eccentric shaft 1 supported at both its ends in main bearings 2*a*, 2*b* (FIG. 2) at the frame 2 of the punch press. The eccentric shaft 1 is driven, for instance, via a coupling/ and braking apparatus 3. Such coupling/ and braking apparatuses for punch presses are generally known such that a detailed description thereof is not needed. The eccentric shaft 1 includes an eccentric section 4. According to the illustrated embodiment this eccentric section 4 is made integrally with the eccentric shaft 1. There are, however, obviously also embodiments foreseen, in which in order to adjust the stroke of the ram of the punch press bushings which could be rotated relative to each other are located at the eccentric section 4. Such designs for adjusting the stroke of the ram are generally known and reference is made here specifically to the Swiss specification CH-A-574 323 and to the U.S. Pat. No. 4,160,409, resp. Two connecting rods 5, 5*a* located adjacent to each other are supported via roller bearings on the eccentric section 4. A connecting rod pin 6 is located at the lower ends of the connecting rods 5, 5*a*. This connecting rod pin 6 includes end sections 6*a*, 6*b*, whereby each end section 6*a*, 6*b* supports a slider 11*a*, 11*b*, which sliders 11*a*, 11*b* are guided in slider guides 12*a*, 12*b* such to perform in operation of the punch press a rectilinear motion.

By means of the structural members described above the rotary movement of the eccentric shaft 1 is transformed in operation of the punch press into a rectilinear stroke movement of the connecting rod pin 6.

Single arm levers 7, 7*a*, 8 and 8*a* are supported at a first end on the connecting rod pin 6. At their opposite, second ends the single arm levers 7, 7*a*, 8 and 8*a* are pivotally mounted via pins 13, 13*a*, 13*b* and 13*c* and link members 14, 14*a*, 14*b* and 14*c* to respective spindle nuts 15, 15*a*, which spindle nuts 15, 15*a* are arranged on respective threaded spindles 16, 16*a*.

Therefore, the sliders 11*a*, 11*b* and the slider guides 12*a*, 12*b* form a unit, by means of which the respective first ends of the single arm levers 7, 7*a*, 8, 8*a* are guided in the direction of the stroke movement.

As can be seen in the drawings, totally four pins 13–13*c*, four link members 14–14*c*, two spindle nuts 15, 15*a* and two threaded spindles 16, 16*a* are present.

Thus, the single arm levers 7, 7*a*, 8 and 8*a* are supported at their second ends located opposite of the connecting rod pin 6 at the frame 2 of the press. These ends are supported in a height adjustable manner, such as will be described in detail further below, wherewith the height position of the rams 32, 32*a* is adjustable.

At points located between the described ends of the single arm levers 7, 7*a*, 8 and 8*a* pins or pivots 18 and 18*a*, resp., are pressed into the levers for respective support of first ends 17 and 17*a*, resp., of first link members 19*a*, 19*b*. These pins of support are pivots that perform stroke movements when the punch press is in operation, whereby for sake of good order it shall be stated, that the movements at those points are not rectilinear movements.

Link members 19*a*, 19*b* are supported at first ends thereof on the pins 18 and 18*a*, resp., and connected at opposite ends to other link members 19, 19*e* to form link member groups. The other link members 19, 19*c* are supported on axially aligned pins 20, 21, 20*b* and 20*a*, 21*a*, 20*c*, resp., defining further pivotal points.

These pins 20, 21, 20*b* and 20*a*, 21*a*, 20*c*, resp., are set into pairs of double levers.

Figure 5:
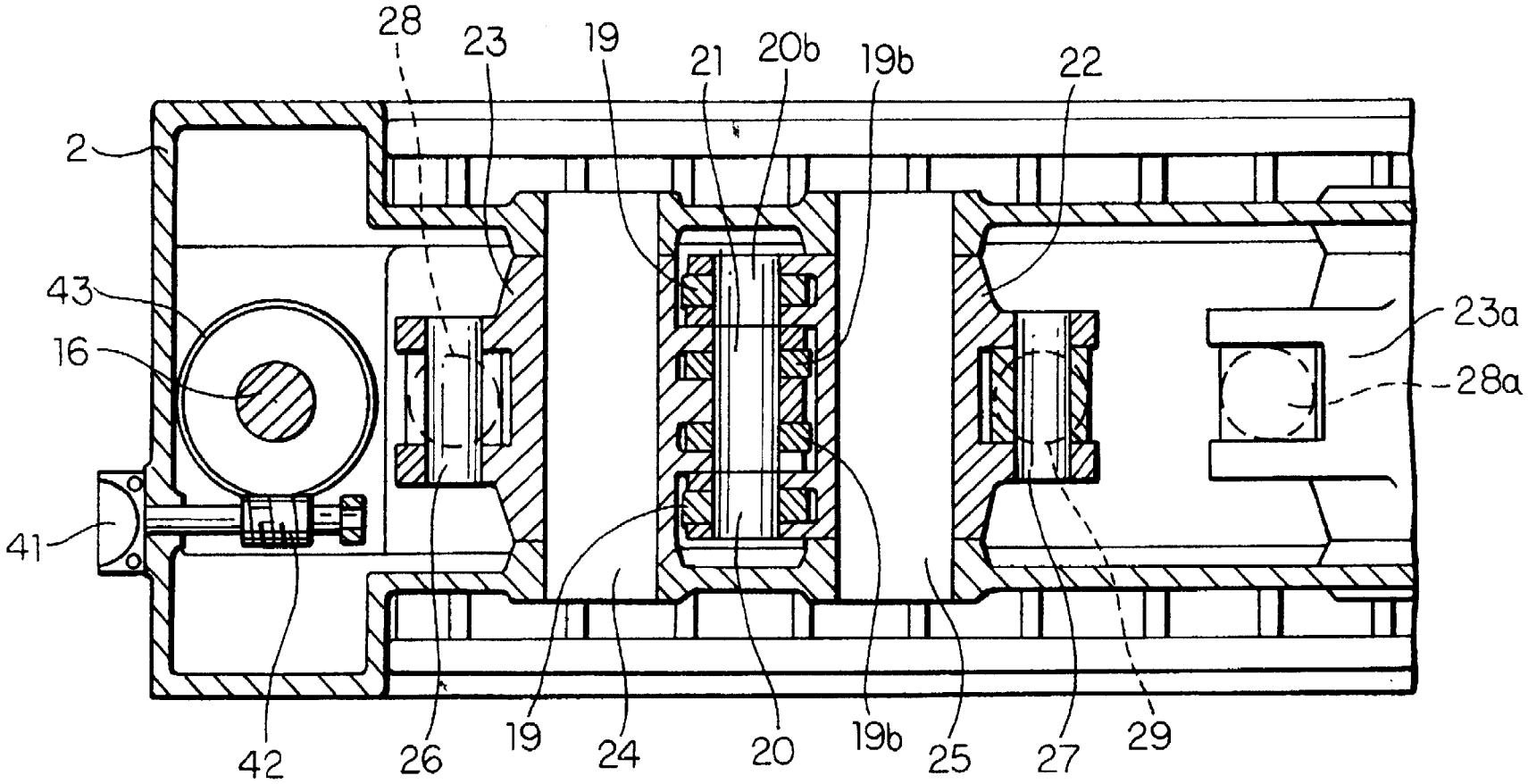
FIG. 5 is a sectional view along line V—V of FIG. 3.

As illustrated in FIG. 1 and specifically in FIG. 5, pin 21 is set into the double lever 23. The pins 20, 20*b* are set into the double lever 22.

Similarly, pin 21*a* is set into the double lever 23*a* and the pins 20*a*, 20*c* are set into the double lever 22*a*.

The double lever 23 is supported on a pin 24 such a rocking support point is present, which pin 24 is in turn supported in the frame 2 of the punch press.

The double lever 22 is supported on a pin 25 defining a further rocking support point, which pin 25 is in turn supported in the frame 2 of the punch press.

Correspondingly, the double lever 23*a* is supported on pin 24*a* and the double lever 22*a* is supported on pin 25*a*.

At its opposite, second end the double lever 23 is pivotably mounted via a pin 26 to a pressing column 28, and the double lever 22 is pivotably mounted by its opposite, second end via a pin 27 to a pressing column 29.

Similarly, considering the double lever pair illustrated at the right side of FIG. 1 and having the double levers 22*a* and 23*a*, the double lever 22*a* is pivotably connected to the pressing column 29*a* and the double lever 23*a* is pivotably mounted to the pressing column 28*a*.

The pressing columns 28 and 29 are connected via pins 30 and 31 to the ram 32, and the pressing columns 28*a* and 29*a* are connected via pins 30*a* and 31*a* to the ram 32*a*.

Alternatively, all four pressing columns 28, 28*a*, 29, 29*a* may also be connected to one single ram, or each pressing column could be connected with one single ram allocated exclusively to this pressing column.

Now, the arrangement of the guides for the rams will be described, whereby specifically attention is drawn to FIGS. 3 and 4.

The ram 32 is rigidly mounted to two guide columns 35, 35b projecting downwards. The guide columns 35, 35b are guided in the plane of advance 36 of the web in guides 33, 33b and the guide columns 35a, 35c are guided in guides 33a, 33c. This guiding arrangement is described extensively in the Swiss patent specification CH-A-568 848 and in the U.S. Pat. No. 3,998,498, resp., whereby the contents of these documents shall be considered incorporated in this specification by reference thereto.

The rams 32, 32a include now additionally a further, thus third guide 34 and 34a, resp., which third guides are located above the plane of advance 36 of the web. Further guide columns 37, 37a mounted rigidly to the frame 2 of the punch press project into these third guides 34 and 34a, resp. The guides 34, 34a include sliding surfaces 38 (see FIG. 4), (see also the above cited documents), which guide surfaces 38 extend in the longitudinal direction of the punch press, i.e. in the direction of advance of the web. Accordingly, the guides 34, 34a prevent a pivoting movement of the rams 32, 32a in a lateral direction of the punch press, allow however due to the sliding surfaces 36 a thermal expansion of the rams 32, 32a without causing a clamping or jamming, resp., at the guides 33, 33b; 33a, 33c; 34, 34a.

The clamping plate of the punch press is identified in the Figures by the reference numeral 39 and the base plate belonging thereto, by the reference numeral 40.

In case of an off-center loading F (see FIG. 3) relative to the longitudinal direction of the punch press, i.e. seen in direction of advance of the web, and acting e.g. between ram 32 and clamping plate 39 and base plate 40, resp., the pressing columns 28, 29 are variously elastically deformed. Therefore, the ram 32 will attain an oblique position such as illustrated in FIG. 3 by the line S, whereby this oblique position (obviously illustrated in a vastly exaggerated manner) of the ram 32 is illustrated by the dash-dotted line T. The elastic deformation and change of the position of the pressing column 29 are illustrated by the dash-dotted line U and correspondingly the dash-dotted line V illustrates the change of the position of the pressing column 28. Furthermore, the oblique position of the pressing column 35 is illustrated by the dash-dotted line W.

Due to the fact now, that the guides 33, 33b are located at the plane of advance 36 of the web, the center point K of the pivotal movement of the ram 32 remains at the plane of advance 36 of the web. This means now, that the ram 32 and the tool 51 (upper tool) mounted thereto do not pivot out of the plane of advance 36 of the web.

The guide 34 or its sliding surfaces 38, resp., (FIG. 4) allow a corresponding shifting movement. The seals 52, 52b between the frame 2 of the punch press and the pressing columns 28, 29 are movable seals, which prevent also in case of an oblique position of the ram 32 oil leaking from the closed frame 2 of the punch press into the working or punching, resp., space and from accordingly soiling the web being worked upon and also the tools.

The behavior of the various structural members has now been described based on an off-center loading of the ram 32. Exactly the same behavior of the corresponding structural members occurs at an off-center loading of the ram 32a.

Figure 3:
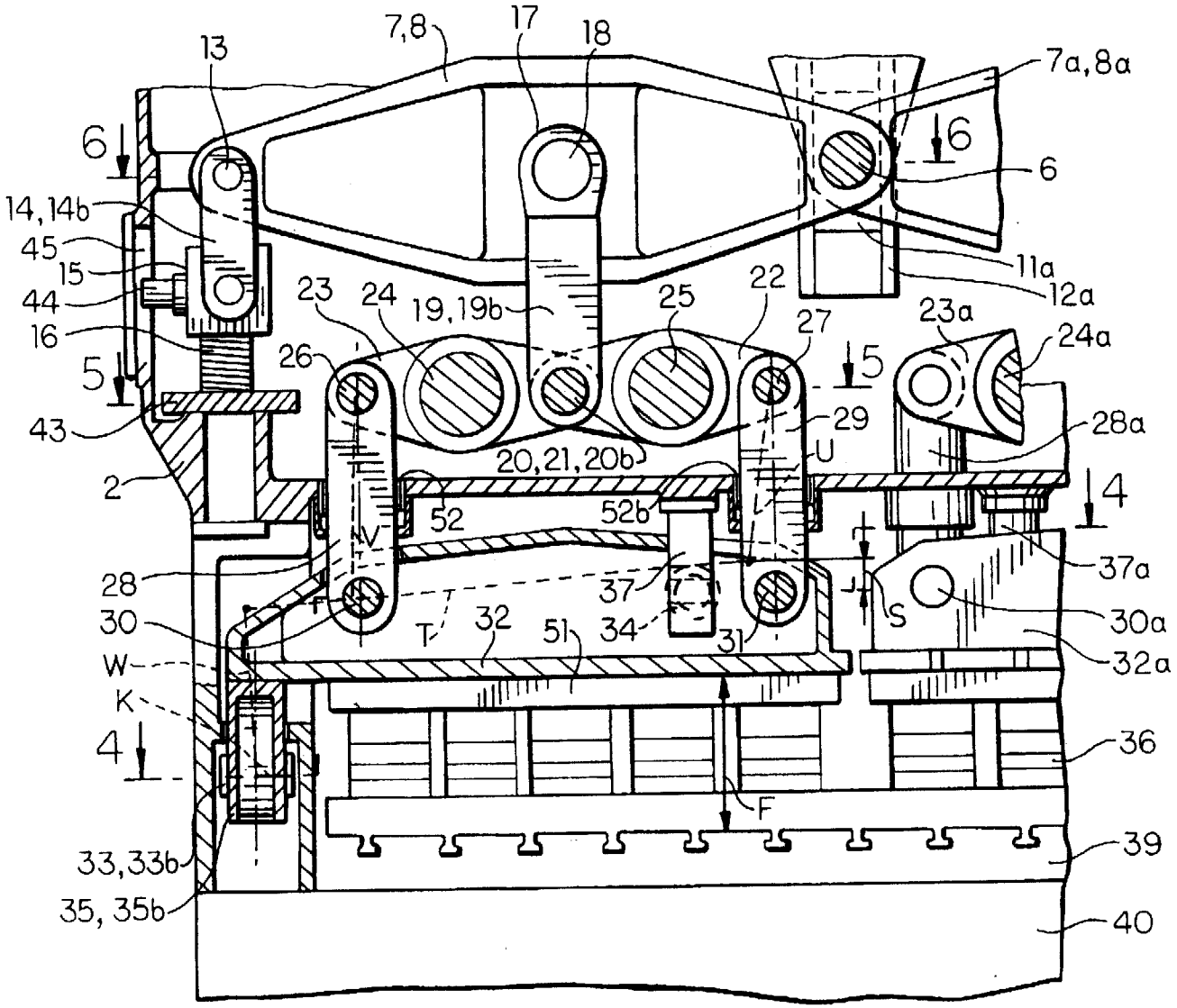
FIG. 3 illustrates on an enlarged scale a portion of FIG. 1.
Figure 4:
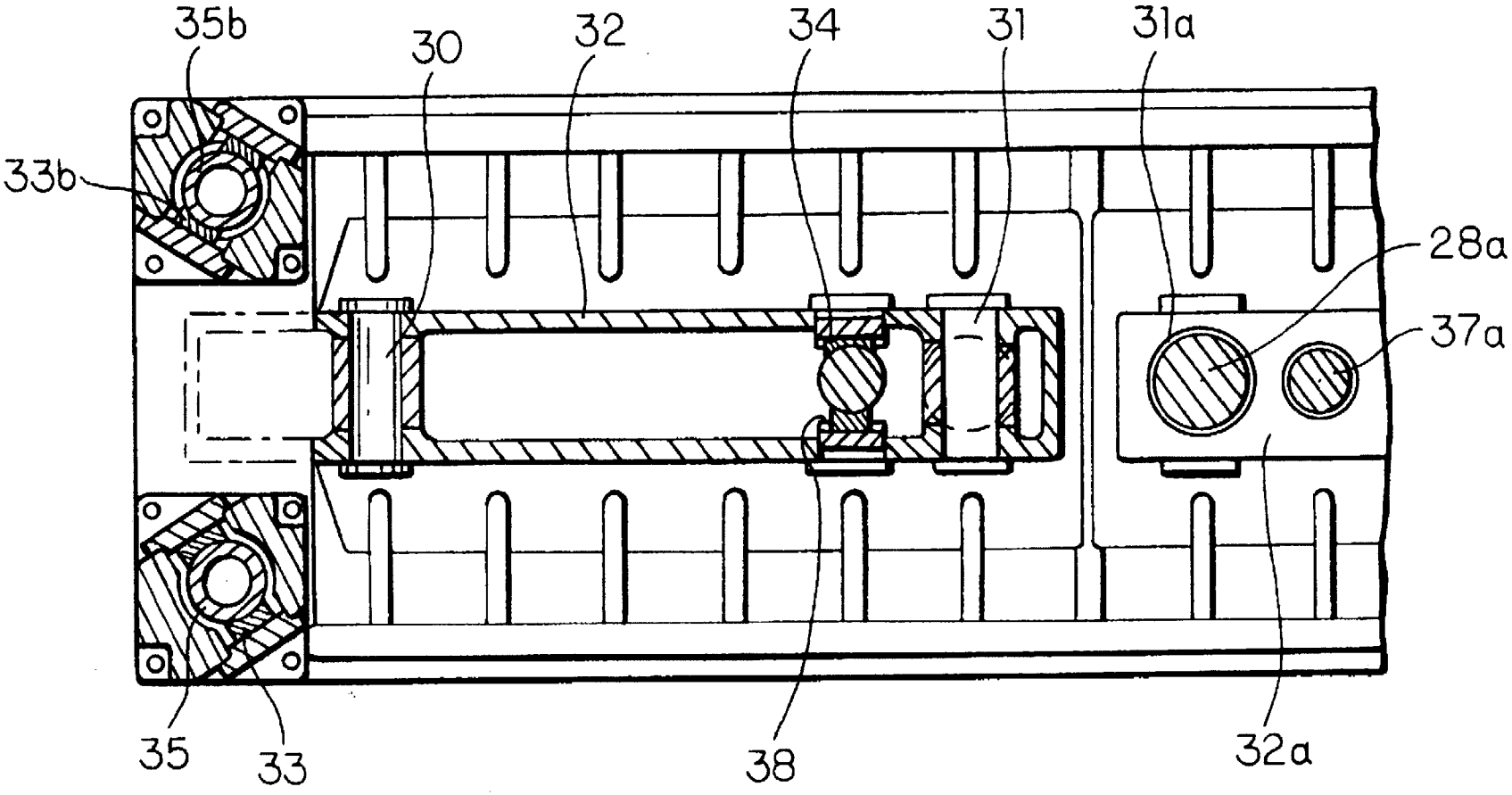
FIG. 4 is a sectional view along line IV—IV of FIG. 3.

Reference is now made to FIG. 5 illustrating a section along line V—V of FIG. 3, and specifically a view of a section through the double levers 22, 23.

The group of link members 19, 19a includes inner link members 19b, which are connected to the inner pin 21, which is set into the end of the double lever 23. In operation, these inner link members 19b transmit the force symmetrically via the double lever 23, supported at the rocking support point on the pin 24, onto the pin 26 and accordingly onto the pressing column 28. The outer link members 19 are connected to the outer pins 20, 20b, which are inserted in one end of the double lever 22. These outer link members 19 transmit in operation the force symmetrically via the double lever 22 supported at the rocking support point on the pin 25 onto the pin 27 and accordingly onto the pressing column 29.

The same corresponding design of the corresponding structural members is present at the single arm levers 7a, 8a, the double levers 22a, 23a, etc. arranged at the right side of FIG. 1.

Figure 6:
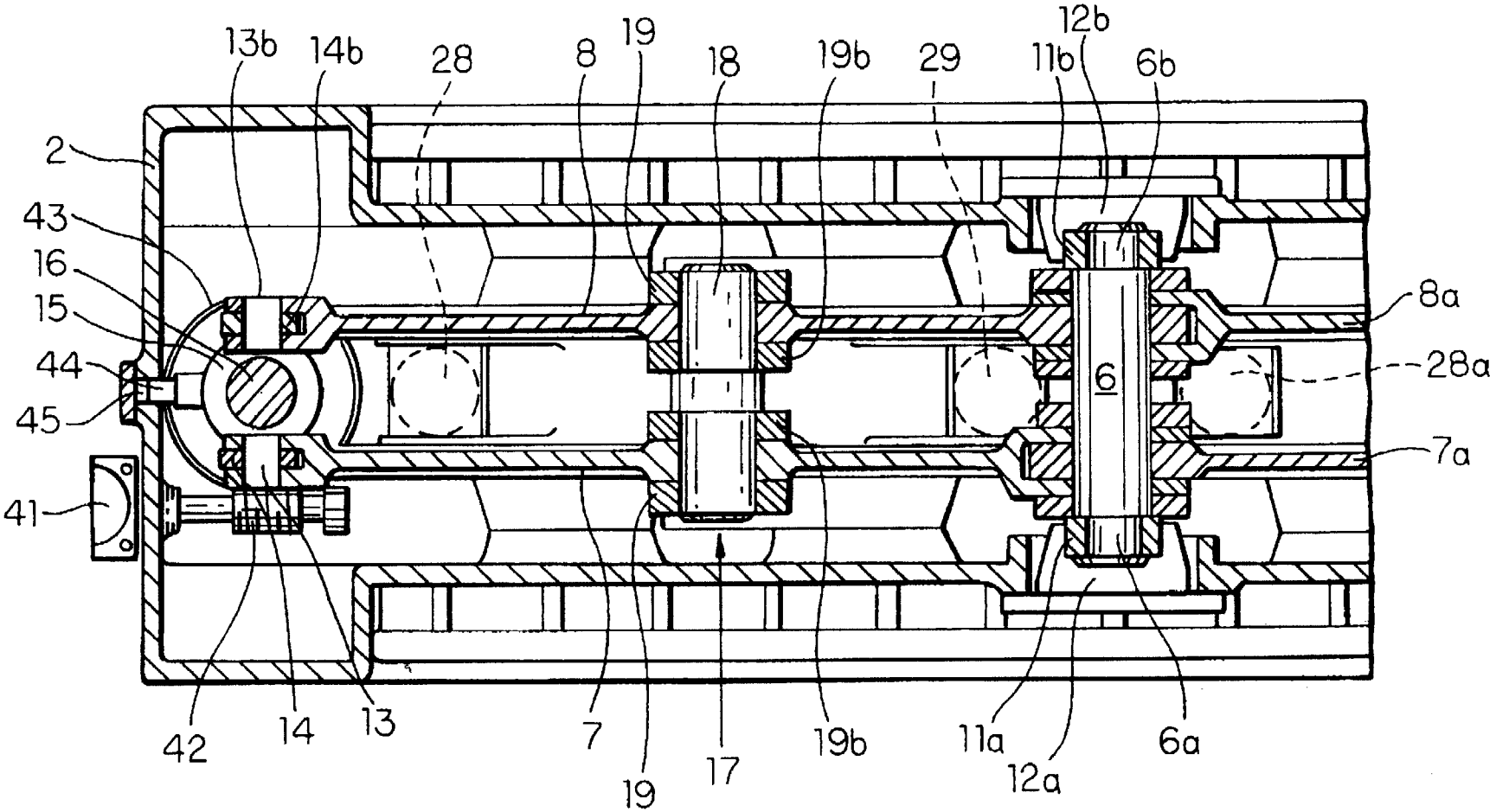
FIG. 6 is a sectional view along line VI—VI of FIG. 3.

FIG. 6 illustrates a section along line VI—VI of FIG. 3 and specifically a section through the single arm levers 7, 8, 7a and 8a, whereby in FIG. 6 only the levers 7 and 8, present at the left side of FIG. 1, are illustrated completely. The following description refers again to the structural members arranged at the left side in FIG. 1.

The force transmitted from the ram 32 via the above described structural members when the punch press is in operation is transmitted in part via the inner link members 19b onto the bolt 18 common to all and accordingly symmetrically to the points of support 17 of the single arm levers 7, 8. The other part of the load is transmitted via the outer link members 19 also onto the bolt 18 common to all and accordingly symmetrically onto the bearing points of the single arm levers 7, 8.

The single arm levers 7, 8 transmit on the one hand the load acting onto the pin 18 or point of support 17, resp., via the pin 6 and via the connecting rods 5, 5a (FIGS. 1, 2) onto the eccentric section 4 of the eccentric shaft 1, which is supported in main bearings 2a, 2b in the frame 2 of the punch press.

On the other hand, the load is transmitted at the opposite ends of the single arm levers 7, 8 via the pins 13, 13b, the link members 14, 14b, the spindle nut 15 onto the threaded spindle 16 which is supported in an unmovable, but rotational manner at the frame 2 of the punch press.

By this above mentioned arrangement of structural members the height position of the ram 32 can be adjusted.

To this end, the threaded spindle 16 includes a worm gear 43, which meshes with a worm 42 (FIGS. 5, 6). The spindle nut 15 includes a projection 44, which projects into a guiding groove 45 of the frame 2 of the punch press, wherewith the spindle nut 15 is guided against a rotating or prevented from rotating, resp. The worm 42 is driven by a servomotor 41.

If the worm 42 is rotated by the servomotor 41, it causes a rotating of the threaded spindle 16 and accordingly a shifting of the spindle nut 15 in vertical direction. This shifting movement is transmitted via the link members 14, 14b onto the pin 13 and accordingly onto the lever pairs 7, 8 and 7, 11, resp.

The position of the connecting rod pin 6 at the opposite side of the lever 7, 8 is fixed in regard to the respective position of the eccentric shaft 1. Accordingly, this connecting rod pin 6 forms the pivotal point of the lever pairs 7, 8, when they are moved by the link members 14, 14b. Accordingly, a vertical movement of the link members 14, 14b caused by the servomotor 41, the worm 42, the worm gear 43 and the threaded spindle 16 leads to a pivotal movement of the pin 18 and conclusively an upwards or downwards, resp., movement of the link members 19, 19*b*. This movement is transmitted via the double levers 22, 23 onto the pressing columns 28, 29, wherewith finally the height position of the ram 32*a* is changed or adjusted, resp.

Because every threaded spindle 16, 16*a* is drivingly connected to its own servomotor drive, the two rams 32, 32*a* may be moved, i.e. adjusted relative to the height position synchronously or also independently from each other. When the punch press is in operation, each ram 32, 32*a* can be height adjusted independently from the other ram 32*a*, 32 in steps of less than 10 μm.

Every punch press needs a structure for balancing the moving masses in operation, whereby a large variety of designs, inclusive mass balancing weights, are known.

Now, the mass balancing of the punch press will be described. Because the moving masses are mirror symmetrical relative to the vertical center line of FIG. 1, only the design of the structural members having a bearing on the mass balancing are described, which are located at the left side of this center line or axis of symmetry, resp.

The total mass of the guide columns 35, 35*b*, of the ram 32, of the pressing columns 28, 29 and of the section of the double levers 22, 23, which extends from their pivotal point where they are pivoted to the pressing columns 28, 29 (bolts 26, 27) to the rocking support point, i.e. the pins 24, 25, equals the total mass of the section of the double levers 22, 23, which extends from the rocking support point, i.e. pins 24, 25 to the pivotal point where the double levers 22, 23 are pivoted to the link members 19, 19*b*, of the link members 19, 19*b*, of the single arm levers 7, 8, of the sliders 11*a*, 11*b*, of the connecting rods 5, 5*a* and of the connecting rod pins 6, 6*a*, 6*b* of the eccentric section 4, of the elongated, upper ends 9, 9*a* of the connecting rods 5, 5*a*, of the laterally extending bars 47, 47*a* pivotally mounted to mentioned upper ends 9, 9*a* and of the pins 46, 46*a*. Accordingly, in operation the oscillating masses of the punch press inclusive the vertical component of the rotating unbalance are balanced, wherewith no additional balancing weights for a balancing of the masses oscillating in vertical direction, inclusive the rotating unbalance in vertical direction must be present, which would unnecessarily increase the mass forces and the loading due to friction, i.e. the friction output.

Figure 2:
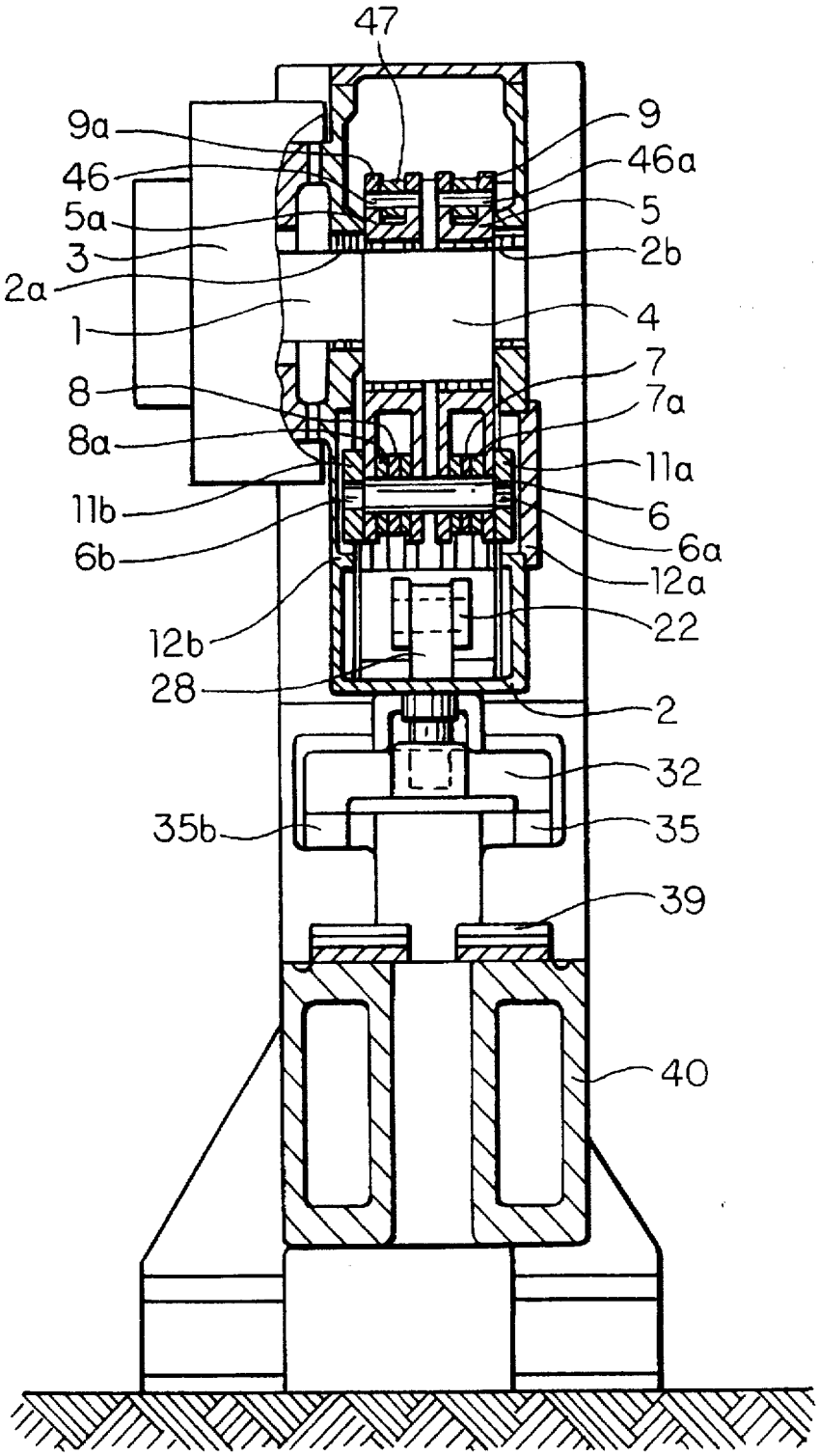
FIG. 2 is a sectional view along line II—II of FIG. 1.
Figure 7:
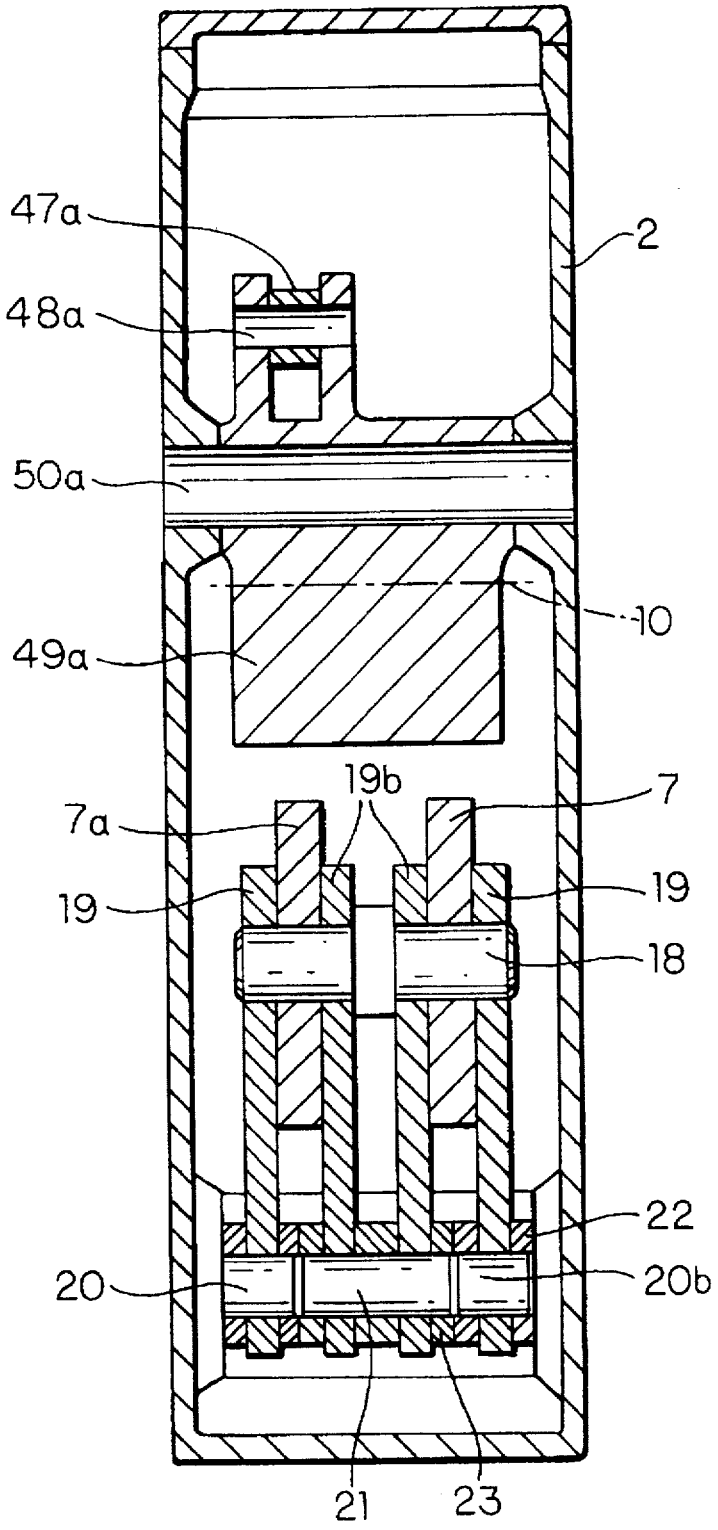
FIG. 7 is a section along line VII—VII of FIG. 1.

In order to balance the horizontal component of the rotating force of imbalance, see FIG. 1, FIG. 2 and FIG. 3, the laterally extending bars 47, 47*a* which are pivotally mounted via the pins 46, 46*a* on extended, upper ends 9, 9*a* of the connecting rods 5, 5*a*, and are pivotally mounted at their opposite ends via pins 48, 48*a* to respective counterweights 49, 49*a*. These counterweights 49, 49*a* are supported on pins 50, 50*a*. The pins 50, 50*a* are thereby located at such a location in the frame 2 of the press and the counterweights 49, 49*a* are supported in such a manner on the pins 50, 50*a* that their mass centers M, Ma are located at the respective point of return of the counterweights 49, 49*a* which pivot in a sense opposite to the pivoting movement of the eccentric section 4 at least approximately at the height level of the center axis 10 of the eccentric shaft 1, such as illustrated in FIGS. 1 and 7 by the dash-dotted line 10.

While there is shown and described the present preferred embodiment of the invention, it is to be distinctly understood that the invention is not limited thereto, but may be otherwise variously embodied and practiced within the scope of the following claims.

What is claimed is:

1. In a punch press having a frame, pressing columns and a punching space for advance in a direction of a web in a plane through the punching space in order to have work performed thereon through a first stroke movement of the pressing columns, the improvement of a structure for producing the first stroke movement, comprising:

at least two first pivots spaced from each other in the direction of the advance of a web through the punching space for performing a second stroke movement; and first and other link members arranged in groups, at least two first link members each having a first and a second, opposite end, the first ends being respectively pivotally mounted to the at least two first pivots, the other link members being arranged as pairs of double levers each having a first and second end, the first ends of each of the pairs of the double levers being pivotally mounted respectively to the second ends of the first link members in such an arrangement that the other link members of each of the pairs of the double levers project in opposite directions from each other and are supported at rocking support pivots on the frame located symmetrically relative to the second ends of the first link members, the second ends of the double levers being pivotally mounted to respective pressing columns.

2. The punch press of claim 1, wherein the double levers of each of the pairs of the double levers are arranged in succession relative to the direction of the advance of he web through the punching space.

3. The punch press of claim 2, wherein there are two of the pairs of the double lever levers arranged in succession relative to the direction of the advance of the web through the punching space.

4. The punch press of claim 1, wherein there are two of the first pivots and link members, the first ends of the first link members being located at equal distances from a plane of symmetry of the frame that extends perpendicularly to the direction of the advance of the web through the punching space.

5. The punch press of claim 1, wherein there are two of the pairs of the double levers and four of the pressing columns.

6. The punch press of claim 1, and further comprising rams pivotally mounted respectively to the pressing columns of each of the pairs of the double levers.

7. The punch press of claim 6, wherein the rams are spaced from each other in the direction of the advance of the web through the punching space.

8. The punch press of claim 6, and further comprising:

two guide columns spaced from each other at one end of each of the rams and guiding units mounted to the frame and arranged in the plane of the web for guiding the guide columns.

9. The punch press of claim 8, and further comprising:

further guide columns mounted rigidly to the frame respectively for each of the rams and spaced from the rams two guide columns; and further guide units respectively located in the rams and above the plane of the web, whereby the rams are guided at three points.

10. The punch press of claim 1, and further comprising:

two single arm levers each having a first and a second, opposite end;

means for guiding the first ends of the single arm levers in a third stroke movement, wherein the first pivots are respectively on the single arm levers between the first and second ends of the single arm levers; and means for respectively supporting pivotally the second ends of the single arm levers on the frame comprising threaded spindles on the frame for respectively adjusting independently a height position of the second ends of the single arm levers.

11. The punch press of claim 10, and further comprising:

rams spaced from each other in the direction of the advance of the web through the punching space, each of the rams being pivotally mounted to at least one of the pressing columns;

two guide columns spaced from each other at one end of each of the rows;

guiding units mounted to the frame and arranged in the plane the web for guiding the guide columns;

wherein the means for guiding the first ends of the single arm levers comprise at least one connecting rod having a projection on one, upper side and a connecting rod pin at an opposite side mounted to sliders guided in slider guides on the frame;

an eccentric shaft rotatably on the frame and having at least one eccentric section supporting the at least one connecting rod; and a laterally extending bar pivotally mounted on a pivot pin on the projection;

wherein the total mass of the guide columns, the rams, and sections of the double levers form where they are pivotally mounted to the pressing columns to the rocking support pivots equals the total mass of sections the double layers from the rocking support pivots to the first link members, the first link members, the single arm levers, the sliders, the connecting rod and the laterally extending bar.

12. The punch press of claim 10, and further comprising:

an eccentric shaft rotatably on the frame;

wherein the means for guiding the first ends of the single arm levers comprises a connecting rod supported on the eccentric shaft, the connecting rod having a first end having a slider guided in a slider guide on the frame, the slider being pivotally mounted to first ends of the single arm levers, the connecting rod further having a diametrically opposite second end;

a lateral bar pivotally mounted to the second end of the connecting rod; and balancing weights eccentrically supported respectively at opposite ends of the lateral bar for balancing horizontal components of rotating unbalanced mass.

13. The punch press of claim 1, and further comprising:

an eccentric shaft rotatably on the frame;

a rectilinearly guided device on the frame; and at least one connecting rod supported on an eccentric section of the eccentric shaft, the connecting rod having an end guided by the device, wherein the device comprises a slider with a pin pivotally mounted to the end of the connecting rod and force transmitting members mounted to the slider and having the first pivots.

14. The punch press of claim 1, and further comprising:

at least two rams on the pressing columns, each of the rams being guided by three guiding columns, two of the guiding columns being rigidly mounted to the associated one of the rams and a third of the guiding columns being rigidly mounted to the frame.

* * * * *